US005406128A

United States Patent [19]

Arinobu

[11] Patent Number: 5,406,128

[45] Date of Patent: Apr. 11, 1995

[54] MULTICIRCUIT CONTROL APPARATUS AND CONTROL METHOD THEREFOR

[75] Inventor: Ichiro Arinobu, Fukuyama, Japan

[73] Assignee: Mitsubishi Denki Kabushiki Kaisha, Tokyo, Japan

[21] Appl. No.: 964,557

[22] Filed: Oct. 21, 1992

Related U.S. Application Data

[63] Continuation of Ser. No. 585,645, Sep. 20, 1990, abandoned.

[30] Foreign Application Priority Data

Sep. 22, 1989 [JP] Japan ..... 1-244938
Oct. 27, 1989 [JP] Japan ..... 1-281264

[51] Int. Cl.[6] ..... G08B 21/00

[52] U.S. Cl. ..... 307/64; 361/9; 361/13; 307/134

[58] Field of Search ..... 361/5–13, 361/2, 3, 4, 5; 307/114–116, 131, 139, 134, 38–41; 315/194–199

[56] References Cited

U.S. PATENT DOCUMENTS 4,215,277 7/1980 Weiner et al. ..... 307/41
4,713,716 12/1987 Takemura et al. ..... 361/2
4,811,010 3/1989 Lucas ..... 340/642
4,859,819 8/1989 Weldon et al. ..... 200/146 R
5,053,907 9/1991 Nishi et al. ..... 361/9
5,136,217 8/1992 Hoffman ..... 318/135

FOREIGN PATENT DOCUMENTS 2563394 10/1985 France .
57-5498 1/1982 Japan ..... H04Q 9/08
60-89029 5/1985 Japan ..... H01H 47/22
60-107549 7/1985 Japan ..... H01H 47/22
62-193481 8/1987 Japan ..... H04Q 9/00

*Primary Examiner*—Steven L. Stephan
*Assistant Examiner*—Aditya Krishnan
*Attorney, Agent, or Firm*—Burns, Doane, Swecker & Mathis

[57] ABSTRACT

In a multicircuit control apparatus (10) including a mechanical main contact (125) and plural semiconductor switching devices such as triacs (13a, —, 13d) each connected in series to the main contact, the main contact is closed by a control circuit 15 prior turning-on of any of the semiconductor switching devices and is also opened by the control circuit 15 after completion of turning-off of all the semiconductor devices.

8 Claims, 8 Drawing Sheets

MULTICIRCUIT CONTROL APPARATUS AND CONTROL METHOD THEREFOR

This application is a continuation of application Ser. No. 07/585,645, filed Sep. 20, 1990, now abandoned.

FIELD OF THE INVENTION AND RELATED ART STATEMENT

1. FIELD OF THE INVENTION

The present invention relates to a multicircuit control apparatus for frequently opening/closing many lighting feeder circuits or the like.

2. DESCRIPTION OF THE RELATED ART

FIG. 6 is a connection diagram showing the conventional multicircuit control apparatus which is disclosed or suggested, for instance, in the gazette of (TOKKAI)-Sho 62-193481. In FIG. 6, a multicircuit 100 includes plural (e.g. four) remote-controlled relays 3A, 3B, 3C and 3D, each of which has a main contact 35 for opening/closing a load circuit (not shown) connected therewith. These remote-controlled relays 3A, 3B, 3C and 3D are connected with four remote control switches 6A, 6B, 6C and 6D via a power source 7, respectively, thereby constituting a multicircuit control apparatus in which each of the remote-controlled relays 3A, —, 3D is controlled by a corresponding one of remote control switches 6A, —, 6D.

FIG. 7 is a circuit diagram showing only the circuit concerning the remote-controlled relay 3A and the remote control switch 6A in FIG. 6.

In the remote-controlled relay 3A, an end of an operation coil 31 is connected to the power source 7, and the other end is connected to both a cathode of a diode 32 and an anode of a diode 33. An anode of the diode 32 and a cathode of the diode 33 are connected to a changeover switch 34. This changeover switch 34 alternately makes connection with one of the diodes 32 and 33 at every inverting excitation of the operation coil 31. The main contact 35, which is to be connected to the load circuit, makes/breaks contact in response to the alternate connecting states of the changeover switch 34.

In the remote control switch 6A, an anode of a diode 61 and a cathode of a diode 62 are connected to the changeover switch 34 of the remote-controlled relay 3A, and a cathode of the diode 61 and an anode of the diode 62 are connected to the power source 7 through switches **63*a* and 63*b*, respectively. A cathode of a diode 65 is connected to the changeover switch 34 via a resistor 64, and an anode of the diode 65 is connected to a cathode of an LED 66. An anode of a diode 68 is also connected to the changeover switch 34 via a resistor 67, and a cathode of the diode 68 is connected to an anode of an LED 69. Both an anode of the LED 66 and a cathode of the LED 69 are connected to the power source 7**.

Next, operation of the above-mentioned conventional remote control switch 6A and remote-controlled relay 3A is described.

In a state shown in FIG. 7, current flows in a closed loop which includes the power source 7, the LED 66, the diode 65, the resistor 64, the changeover switch 34, the diode 32 and the operation coil 31. Flowing of the current is allowed in only one direction because of presence of the diodes 65 and 32, and the LED 66 emits light. Since the current is limited by the resistor 64, excitation of the operation coil 31 is not enough to actuate the changeover switch 34. From this state, when the switch **63*b* is closed, current flows through the switch 63*b*, the diode 62, the changeover switch 34, the diode 32 and the operation coil 31. Since this current is not limited by any resistor, the operation coil 31 is sufficiently excited, thereby causing the changeover motion of the changeover switch 34. Thus, the changeover switch 34 instantaneously changes the connection from a terminal 34*b* to a terminal 34*a*, and the main contact 35 breaks contact at the same time. Once the changeover switch 34 makes connection to the terminal 34*a*, the current does not flow any more due to the reverse polarity of the diode 33. In this state, current flows in a closed loop which includes the power source 7, the operation coil 31, the diode 33, the changeover switch 34, the resistor 67, the diode 68 and the LED 69. Flowing of the current is allowed in only one direction due to presence of the diodes 33 and 68, and the LED 69 emits light. Since the current is limited by the resistor 67, excitation of the operation coil 31 is not enough to actuate the changeover switch 34. From this state, when the switch 63*a* is closed, current flows through the operation coil 31, the diode 33, the changeover switch 34, the diode 61 and the switch 63*a*. Since this current is not limited by any resistor, the operation coil 31 is sufficiently excited, thereby causing the changeover motion of the changeover switch 34. Thus, the changeover switch 34 instantaneously changes the connection from the terminal 34*a* to the terminal 34*b*, and the main contact 35 makes contact at the same time. Once the changeover switch 34 makes connection to the terminal 34*b*, the current does not flow any more because of the reverse polarity of the diode 32, thus returning to the initial state shown by FIG. 7**.

The above-mentioned control is carried out in substantially only one loop with two wires connected to the remote control switch 6A by utilizing respective half waves of AC power source 7 as two directional signals. This has been known as the "two-wire" control method.

In the above-mentioned conventional multicircuit control apparatus, the main contact 35 is a mechanical contact which is mechanically actuated by electromagnetic force generated by the operation coil 31. Since the operation coil 31 necessitates a comparatively large energy to generate such electromagnetic force, the total energy required becomes large to control many circuits such as the lighting feeder circuits. Therefore, the power source 7, which is the energy only for the control, has to be of large capacity. This is of course undesirable in terms of saving energy.

In order to save energy, one of ordinary skill in the art could have an idea of replacing the mechanical contact with a solid state device such as a solid state relay. However, employment of the solid state device entails another serious problem in that insulation between the primary line (power source) and the secondary line (load) of the solid state device is not reliable. This is caused by leakage current through the solid state device or a protection circuit such as a snubber circuit provided in parallel with the solid state device. Therefore, even after completion of opening the circuit, when an operator touches the secondary line with his fingers, he receives an unexpected electrical shock. Besides, the leakage current may cause an accident such as a fire. Under these circumstances, it has been difficult in practice to use solid state devices in place of the mechanical contacts.

OBJECT AND SUMMARY OF THE INVENTION

An object of the present invention is to offer a multicircuit control apparatus which has a very long lifetime and high insulating ability of during off time and reduces the energy required for operation.

In order to achieve the above-mentioned objects, the multicircuit control apparatus of the present invention comprises:

a main contact which is to be connected to a power source;

a plurality of semiconductor switching devices, each of which is connected in series to the main contact and is to be connected to a load; and a control circuit which closes the main contact before turning one of the switching devices on in response to an on-command signal supplied thereto and opens the main contact after turning-off of all the switching devices in response to off-command signals supplied thereto.

In another aspect, the present invention involves a method for controlling a multicircuit control apparatus having a main contact and a plurality of semiconductor switching devices each connected in series to the main contact, the method comprising:

an on-operation procedure including a first step of closing the main contact and a second step of turning at least one of the semiconductor switching devices on; and an off-operation procedure including a first step of turning all the semiconductor switching devices off and a second step of opening the main contact.

While novel features of the present invention are set forth particularly in the appended claims, the present invention, both as to organization and content, will be better understood and appreciated, along with other objects and features thereof, from the following detailed description of an embodiment given in conjunction with the drawings.

DESCRIPTION OF THE PREFERRED EMBODIMENT

Hereafter, a preferred embodiment of the present invention is described with reference to the accompanying drawings.

Figure 1:
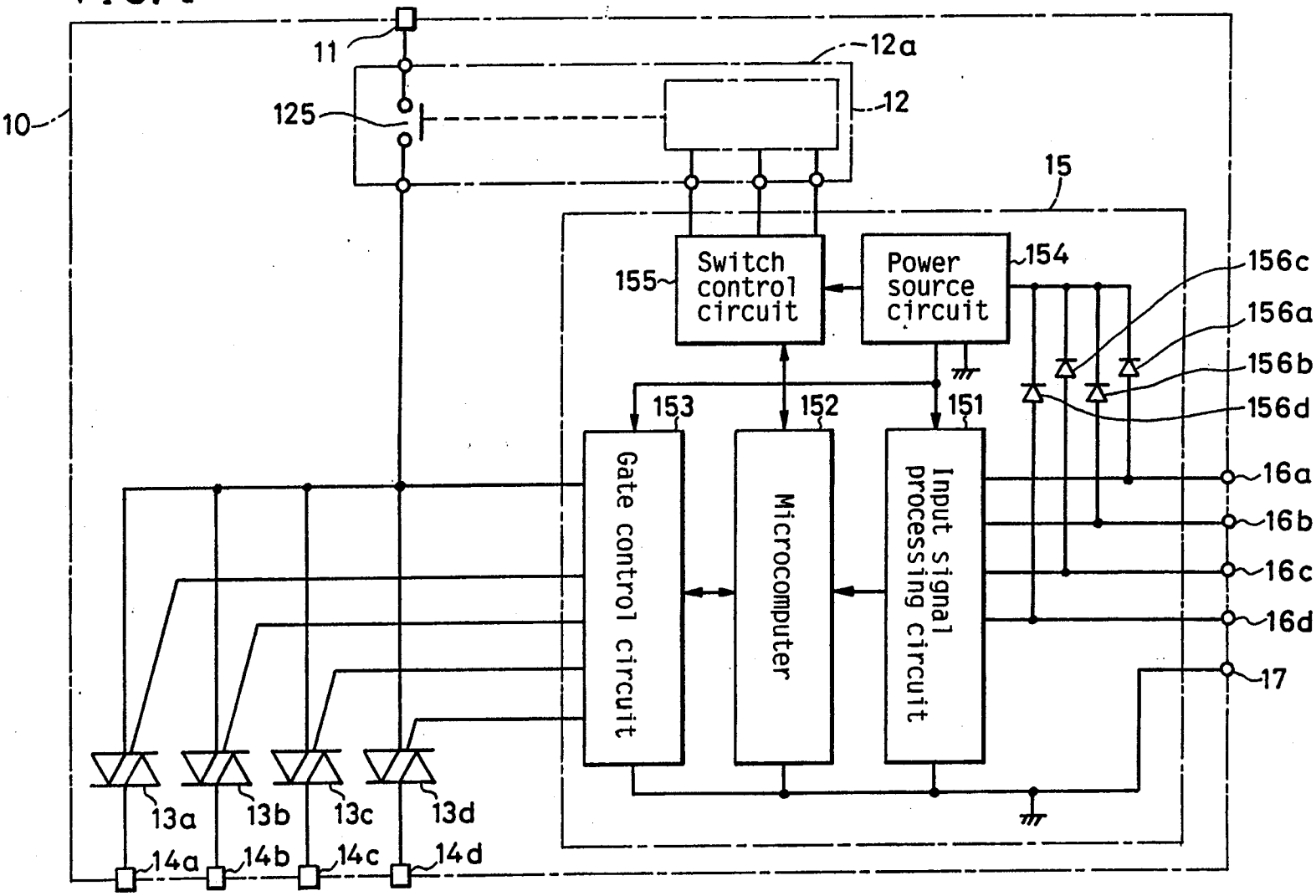
FIG. 1 is a single-line diagram showing a multicircuit control apparatus of the present invention.

FIG. 1 is a single-line diagram showing a multicircuit control apparatus 10. The multicircuit control apparatus 10 includes an electromagnetic switch 12, plural (e.g. four) semiconductor control devices such as triacs 13*a*, 13*b*, 13*c* and 13*d*, and a control circuit 15 and has a primary terminal 11, four secondary terminals 14*a*, 14*b*, 14*c*, and 14*d* and four control terminals 16*a*, 16*b*, 16*c*, and 16*d* with a common terminal 17. A main contact 125 of the electromagnetic switch 12 is connected to the primary terminal 11, and each of the triacs 13*a*, 13*b*, 13*c*, and 13*d* is connected in series with the main contact 125 of the electromagnetic switch 12. Secondary lines of the triacs 13*a*, 13*b*, 13*c*, and 13*d* are connected to the secondary terminals 14*a*, 14*b*, 14*c* and 14*d*, respectively. A control section 12*a* of the electromagnetic switch 12 and gate lines of the triacs 13*a*, —, 13*d* are connected to the control circuit 15 which receives signals from the control terminals 16*a*, —, 16*d* and its common terminal 17. The primary terminal 11 is connected to a main power source (not shown), and the secondary terminals 14*a*, —, 14*d* are connected to respective loads such as lighting equipment.

The control circuit 15 is composed of an input signal processing circuit 151, a microcomputer 152, a gate control circuit 153, a power source circuit 154, a switch control circuit 155 and plural diodes 156*a*, —, 156*d*. Input signals coming from the remote control switches 6A, —, 6D (see FIG. 2) are supplied to the microcomputer 152 through the input signal processing circuit 151. The microcomputer 152 takes the present on/off states of the main contact 125 and the triacs 13*a*, —, 13*d* into consideration and forwards control signals to the gate control circuit 153 and the switch control circuit 155, thereby controlling the triacs 13*a*, —, 13*d* and the electromagnetic switch 12, respectively. Four diodes 156*a*, —, 156*d* are provided in order to separate signals given to the control terminals 16*a*, —, 16*d* from one another.

Figure 2:
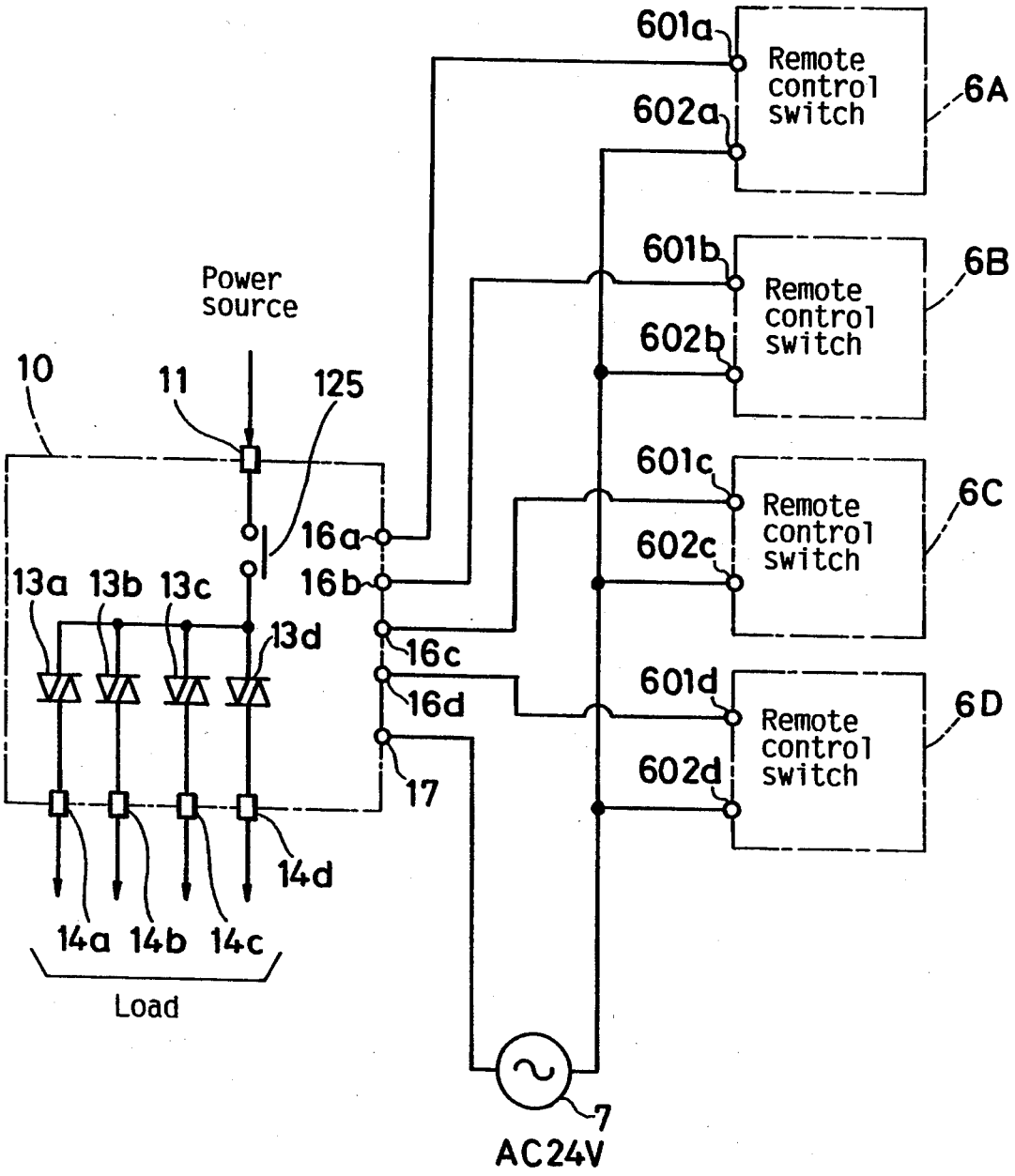
FIG. 2 is a circuit diagram showing connections between the multicircuit control apparatus 10 in FIG. 1 and four remote control switches 6A, —, 6D.

FIG. 2 is a circuit diagram showing connections between the above-mentioned multicircuit control apparatus 10 and four remote control switches 6A, —, 6D each having two terminals 601*x* and 602*x* (x=a, b, c, d) for the two-wire control. The terminals 602*x* (x=a, b, c, d) are connected to the common terminal 17 via a power source 7 of 24V AC, and the terminals 601*x* (x=a, b, c, d) are connected to the control terminals 16*a*, 16*b*, 16*c* and 16*d*, respectively. The triacs 13*a*, —, 13*d* are switched on or off by the corresponding remote control switches 6A, —, 6D, respectively.

Figure 3:
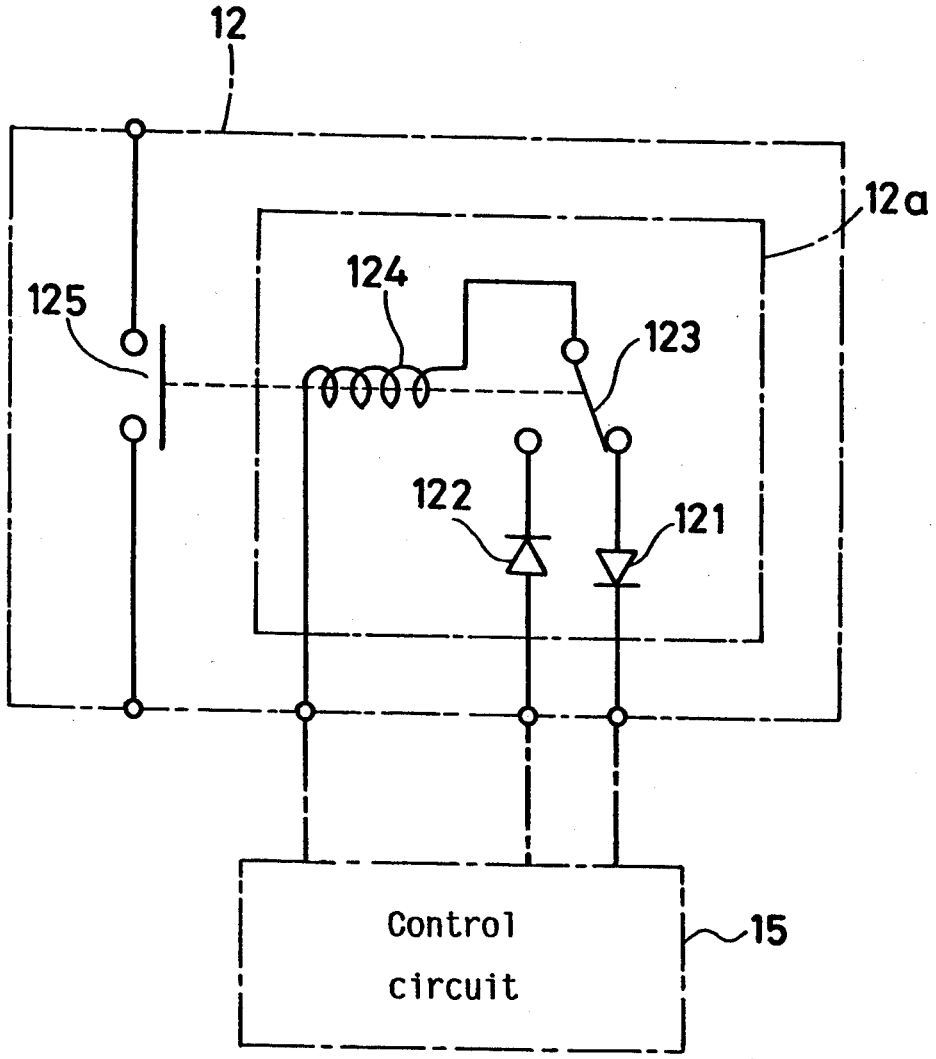
FIG. 3 is a circuit diagram showing an internal circuit of an electromagnetic switch 12 in FIG. 1.

FIG. 3 is a circuit diagram showing an internal circuit of the electromagnetic switch 12 which is composed of the main contact 125 and the control section 12*a*. In FIG. 3, a cathode of a diode 121, an anode of a diode 122 and one end of an operation coil 124 are connected to the control circuit 15 (FIG. 1). The other end of the operation coil 124 is connected to a common terminal of a changeover switch 123 which alternately makes connection with one of the diodes 121 and 122 at every inversion of excitation of the operation coil 124. The main contact 125 is also actuated by the operation coil 124 to make/break contact in response to the alternate state of the changeover switch 123. That is, when the changeover switch 123 makes connection with the diode 121 as shown in FIG. 3, the main contact 125 is opened. When the changeover switch 123 makes connection with the diode 122, the main contact 125 is closed.

Figure 4A:
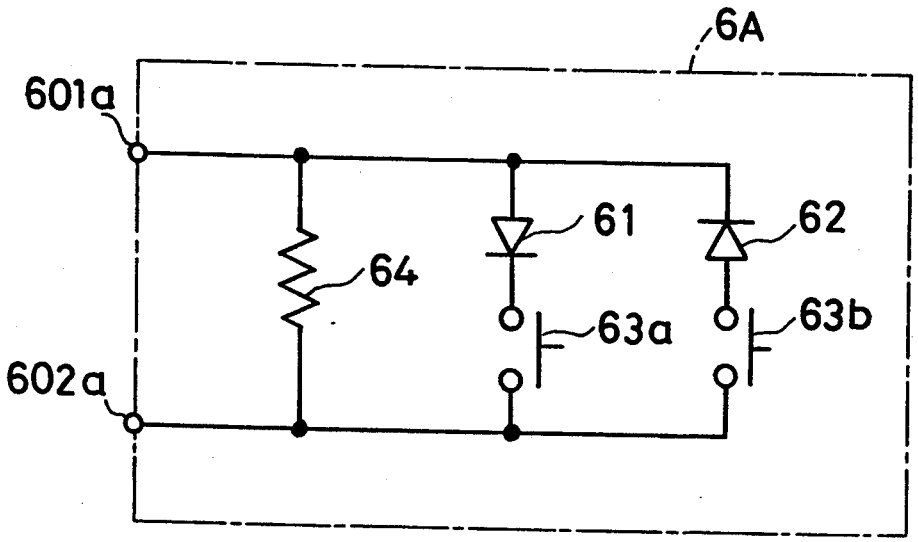
FIG. 4(*a*) and FIG. 4(*b*) are circuit diagrams showing two types of an internal circuit of the remote control switch 6A in FIG. 2.
Figure 4B:
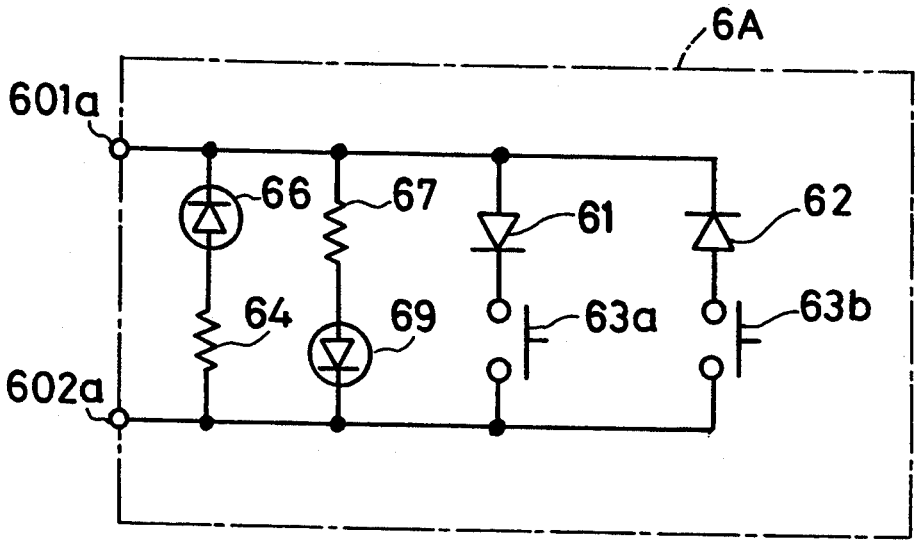

FIG. 4(*a*) and FIG. 4(*b*) are circuit diagrams showing two types of an internal circuit, for instance, of the remote control switch 6A. Other remote control switches 6B, —, 6D have the same internal circuit as that of the remote control switch 6A. In FIG. 4(*a*), an anode of a diode 61 and a cathode of a diode 62 are connected to the terminal 601*a*. One end of a switch 63*a* and one end of a switch 63*b* are connected to the diodes 61 and 62, respectively, and both the other ends of the switches 63*a* and 63*b* are connected to the terminal 602*a*. A resistor 64 is connected between the terminals 601*a* and 602*a*.

In another circuit shown by FIG. 4(*b*), the diodes 61, 62 and the swltches 63*a*, 63*b* are provided in the similar way to the above. Further, between the terminals 601*a* and 602*a*, operation indicator circuits are provided. That is, an anode of an LED 66 is connected to the terminal 602*a* via a resistor 64, and its cathode is connected to the terminal 601*a*. A cathode of an LED 69 is connected to the terminal 602*a*, and its anode is connected to the terminal 601*a* via a resistor 67.

Figure 5:
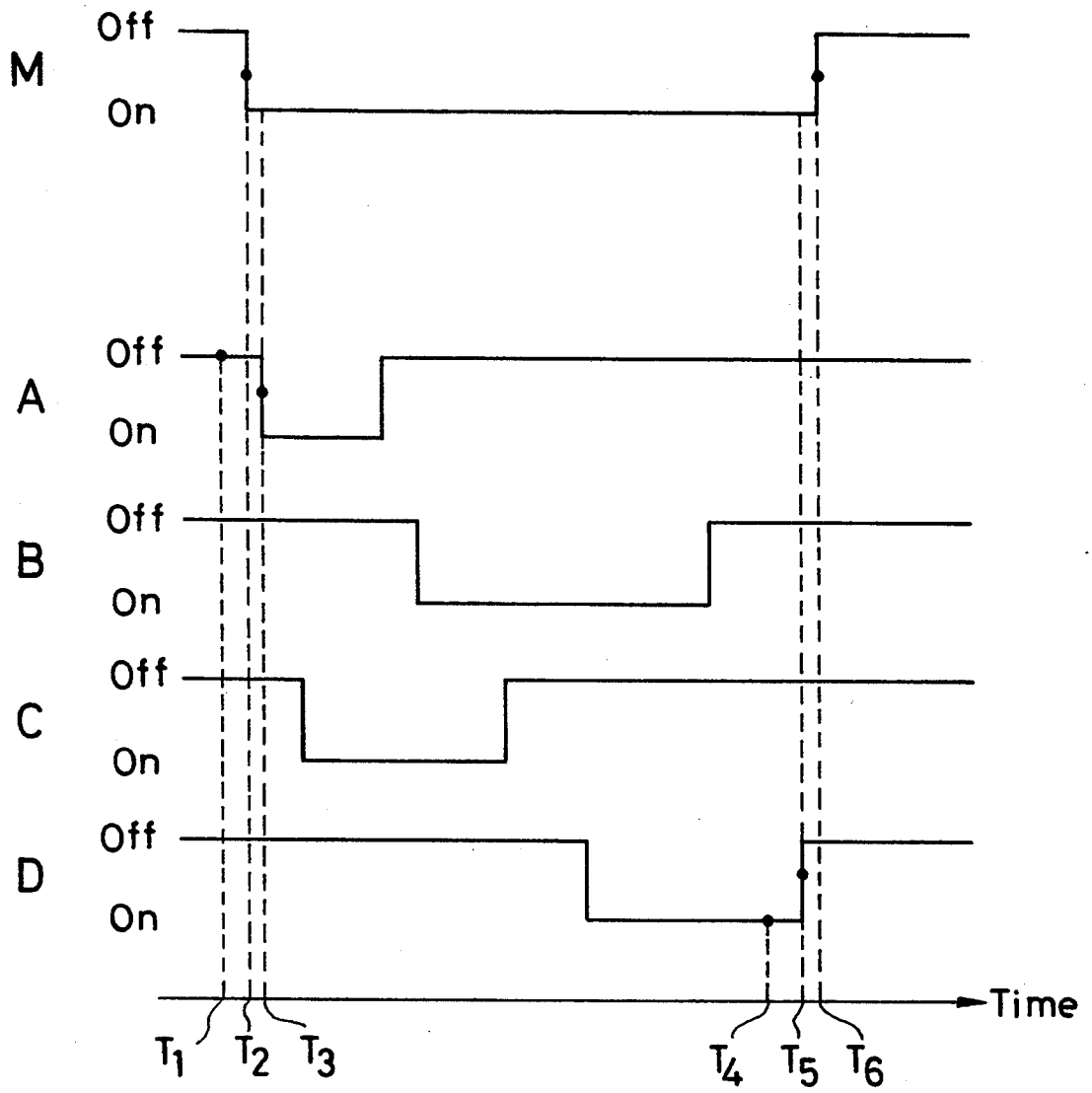
FIG. 5 is a graph showing each on or off state of a main contact 125 and plural triacs 13*a*, —, 13*d* in FIG. 2.

Next, operation of the above-mentioned embodiment is described with reference to FIGS. 1–5. FIG. 5 is a graph showing each on or off state of the main contact 125 and the triacs 13*a*, —, 13*d*. A time chart "M" represents an on or off state of the main contact 125, and time charts A, B, C and D represent on or off states of the triacs 13*a*, 13*b*, 13*c* and 13*d*, respectively.

In a state that all the triacs 13*a*, —, 13*d* are off, for example, when the remote control switch 6A (FIG. 2) turns on by closing the switch 63*b* (FIG. 4(*a*) or 4(*b*)) at the time $T_1$ (FIG. 5), a certain voltage based on half waves of the power source 7 is applied to the terminal 16*a* of the multicircuit control apparatus 10. The control circuit 15 receives the above-mentioned voltage and gives the operation coil 124 (FIG. 3) of the electromagnetic switch 12 an excitation signal. The main contact 125 is thereby closed at the time $T_2$. Since all the triacs 13*a*, —, 13*d* are still off at this point in time, the main contact 125 does not close any load circuit but merely makes connection. Subsequently, the control circuit 15 gives a gate of the triac 13*a* a turn-on signal at the time $T_3$. The triac 13*a* is thereby turned on, and the power is supplied to the load (not shown) connected therewith. In the cases where one of other triacs 13*b*, 13*c* and 13*d* is turned on instead of the triac 13*a*, a similar operation to that mentioned above is carried out. After the turning-on of one triac (e.g. 13*a*), it is possible to quickly turn on another triac upon receipt of an on-command from any of the remote control switches 6B, —, 6D. Whereupon, once the control circuit 15 turns the electromagnetic switch 12 on, the control circuit 15 maintains the on-state of the electromagnetic switch 12 as long as at least one triac is on. This will be described in detail with an example shown in FIG. 5 wherein four triacs 13*a*, —, 13*d* are turned on and subsequently off in turn with an overlap time when two triacs are on. That is, the triac 13*c* is turned on as shown by the time chart C before the triac 13*a* (the time chart A) is turned off. Next, the triac 13*b* (the time chart B) is turned on before the triac 13*c* is turned off. Further, the triac 13*d* (the time chart D) is turned on before the triac 13*b* is turned off. In the above-mentioned process, since at least one triac is always on, the main contact 125 (the time chart M) is maintained to be in the on-state by the control circuit 15. When the remote control switch 6D is switched off at the time $T_4$, the control circuit 15 shuts off the gate signal for the triac 13*d*. The triac 13*d* is thereby turned off at the time $T_5$. At that moment, the control circuit 15 detects a state wherein all gate voltages of the triac 13*a*, —, 13*d* are zero, and subsequently, the control circuit 15 actuates the electromagnetic switch 12 to open its main contact 125 at the time $T_6$. Since the load current has been already broken by the triacs 13*a*, —, 13*d*, the main contact 125 does not break the current in substance but makes disconnection only. Owing to the mechanical "open" state of the main contact 125, secondary lines of the main contact 125 are fully insulated from the primary lines.

When one or more on-command signals are given from the remote control terminals 6A, —, 6D again, the control circuit 15 turns the main contact on and subsequently turns the corresponding triac on. While the main contact 125 is closed, on or off control can be frequently carried out by the triacs 13*a*, —, 13*d* which are opened/closed with small power consumption without arc. That is, insulation of the secondary line in the off-time, which is important to safety, is secured by the main contact 125, and both saving energy and long lifetime are secured by the triacs 13*a*, —, 13*d* which are the semiconductor control devices.

Figure 5A:
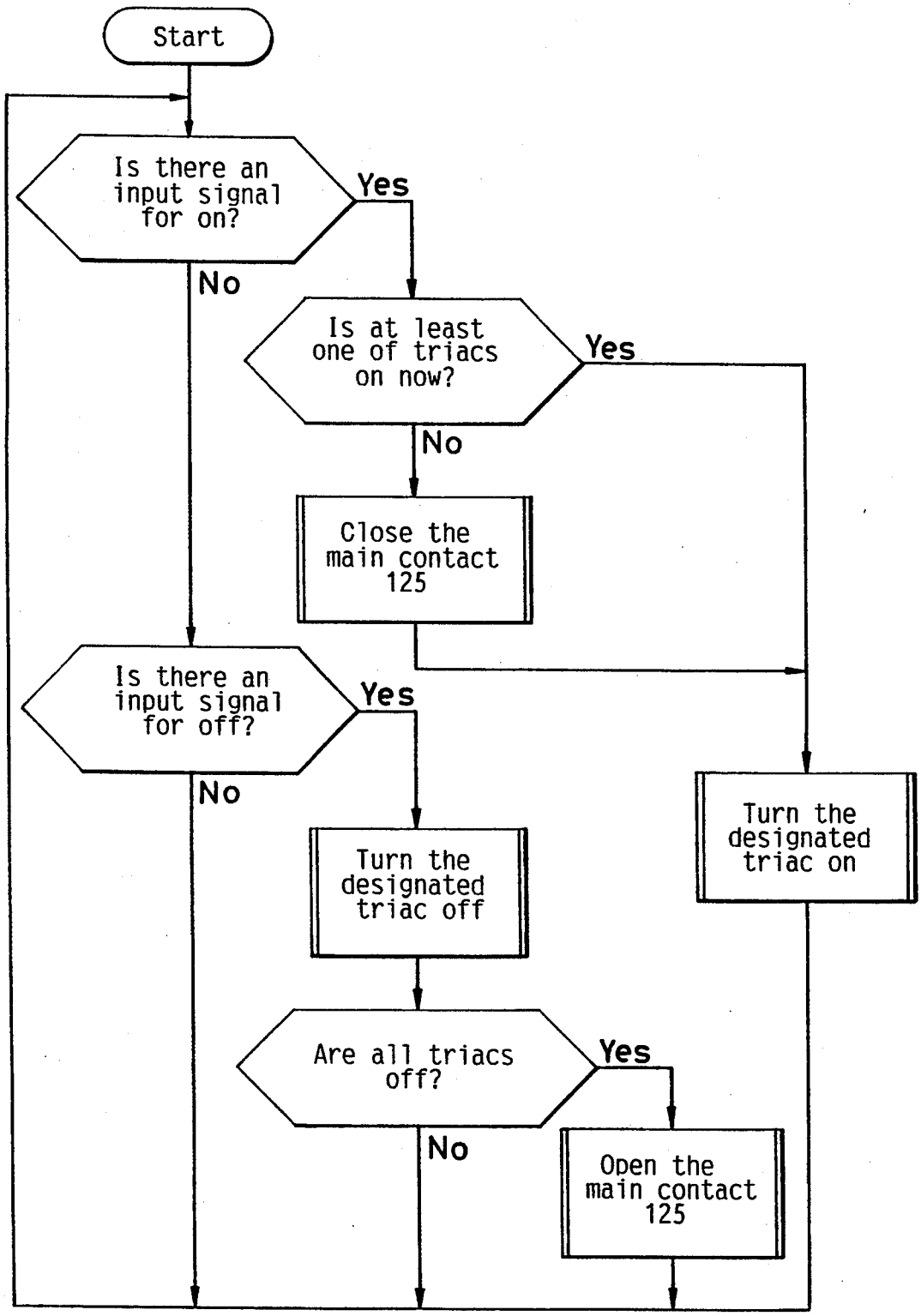
FIG. 5*a* is a flow chart which is to be executed by a microcomputer 152 in FIG. 1.
Figure 6:
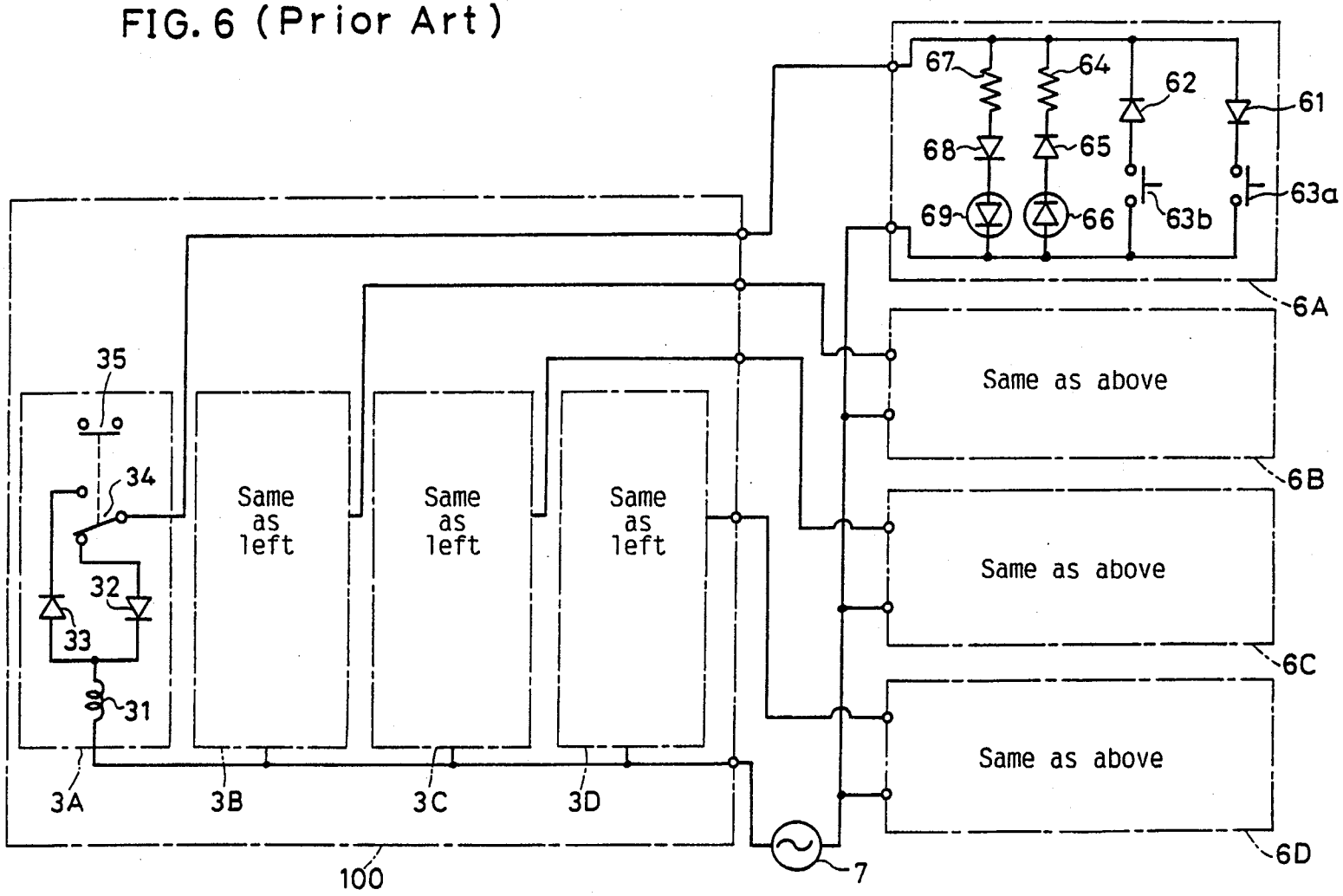
FIG. 6 (Prior Art)
FIG. 6 is a circuit diagram showing the conventional multicircuit control apparatus.
Figure 7:
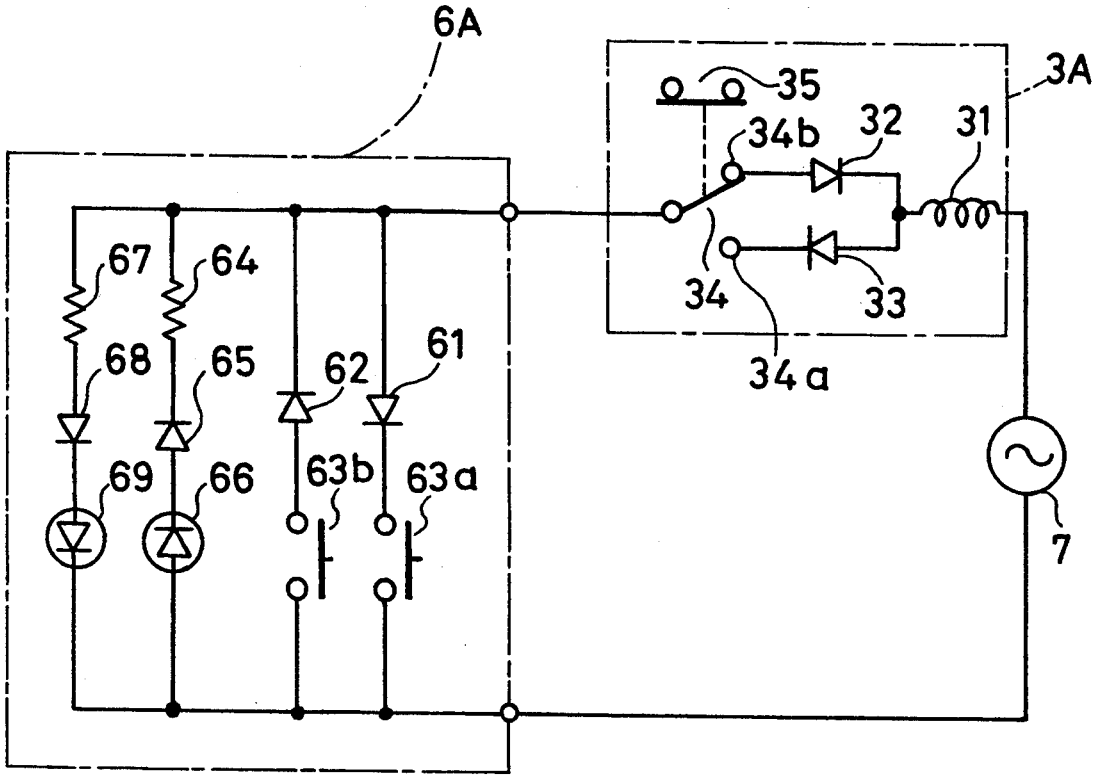
FIG. 7 (Prior Art)
FIG. 7 is a circuit diagram showing the conventional two-wires control circuit extracted from FIG. 7.

In this embodiment, the above-mentioned on-operation procedure and off-operation procedure are executed in accordance with a flow chart shown in FIG. 5*a* which is stored in the microcomputer 152.

Although the invention has been described in its preferred form with a certain degree of particularity, is understood that the present disclosure of the preferred form may be changed in the details of construction and various combinations and arrangements of parts may be resorted to without departing from the spirit and the scope of the invention as hereinafter claimed.

What is claimed is:

1. A method of controlling a multicircuit control apparatus having a main contact and a plurality of semiconductor switching devices each connected in series with said main contact, said method comprising the steps of:

an on-operation procedure including a first step of closing said main contact and a subsequent second step of turning at least one of said semiconductor switching devices on; and an off-operation procedure including a first step of detecting all of said semiconductor switching devices to be in an off-state and a subsequent second step of opening said main contact.

2. A method as in claim 1, wherein:

said on-operation procedure operates in response to an on-command signal supplied to a control circuit by an input control operation; and said off-operation procedure operates in response to a an off-command signal that is for turning, off a final one of said switching devices that is on, said off-command signal being supplied to said control circuit by input control operations.

3. A multicircuit control apparatus comprising:

a main contact which is to be connected to a line from a power source;

a plurality of semiconductor switching devices, each of which is connected in series with said main contact and is to be connected to a load; and a control circuit for discretely controlling said semiconductor switching devices and controlling said main contact only when all of said semiconductor switching devices are in an off-state, said control circuit closing said main contact prior to turning one of said switching devices on when an on-command signal for said one of said switching devices is received, said control circuit opening said main contact only on condition that an off-state of all of said switching devices has first been detected.

4. A multicircuit control apparatus comprising:

a main contact which is to be connected to a line from a power source;

a plurality of semiconductor switching devices, each of which is connected in series with said main contact and is to be connected to a load; and a control circuit for discretely controlling said semiconductor switching devices and controlling said main contact only when all of said semiconductor switching devices are in an off-state, said control circuit closing said main contact prior to turning one of said switching devices on when an on-command signal for said one of said switching devices is supplied by an input control means, said control circuit opening said main contact only on condition that an off-state of all of said switching devices has first been detected.

5. The multicircuit control apparatus of claim 2, wherein the control circuit for controlling said main contact and said semiconductor switching devices includes a microcomputer.

6. A method as in claim 1, further comprising the steps of a control procedure for turning said semiconductor switching devices on and off with said main contact kept closed.

7. A multicircuit control apparatus as in claim 2, wherein the control circuit turns said switching devices on and off in response to respective on-command signals and off-command signals with said main contact kept closed.

8. A multicircuit control apparatus as in claim 4, wherein the control circuit turns said switching devices on and off in response to respective on-command signals and off-command signals with said main contact kept closed.

* * * * *